US007931033B2

(12) United States Patent
Park et al.

(10) Patent No.: US 7,931,033 B2
(45) Date of Patent: Apr. 26, 2011

(54) DISH WASHER

(75) Inventors: Nung Seo Park, Seoul (KR); Sang Heon Yoon, Gwangmyung-si (KR); Yong Jin Choi, Daegoo-si (KR); Si Moon Jeon, Seoul (KR); Dae Yeong Han, Seoul (KR)

(73) Assignee: LG Electronics Inc., Seoul (KR)

( * ) Notice: Subject to any disclaimer, the term of this patent is extended or adjusted under 35 U.S.C. 154(b) by 880 days.

(21) Appl. No.: 11/515,392

(22) Filed: Sep. 5, 2006

(65) Prior Publication Data

US 2007/0084486 A1 Apr. 19, 2007

(30) Foreign Application Priority Data

Sep. 6, 2005 (KR) ..... 10-2005-0082553

(51) Int. Cl.
*B08B 3/10* (2006.01)

(52) U.S. Cl. ..... 134/108; 68/15

(58) Field of Classification Search ..... 134/108; 68/15

See application file for complete search history.

(56) References Cited

U.S. PATENT DOCUMENTS

| | | | | | |
|---|---|---|---|---|---|
| 1,414,634 | A | * | 5/1922 | Fassio | 134/96.1 |
| 1,755,101 | A | * | 4/1930 | Clark et al. | 34/187 |
| 2,216,388 | A | * | 10/1940 | Hampel | 134/47 |
| 2,347,490 | A | * | 4/1944 | Legeman | 236/44 C |
| 2,618,281 | A | * | 11/1952 | Hior Ornas | 134/57 D |
| 3,049,450 | A | * | 8/1962 | Koons et al. | 134/11 |
| 3,055,378 | A | * | 9/1962 | Alford | 134/186 |
| 3,072,128 | A | * | 1/1963 | James | 134/57 D |
| 3,087,504 | A | * | 4/1963 | Geschka | 134/57 D |
| 3,160,170 | A | * | 12/1964 | Sampsel | 137/341 |
| 3,890,987 | A | * | 6/1975 | Marcussen et al. | 134/57 D |
| 4,279,384 | A | * | 7/1981 | Yamamoto | 239/67 |
| 4,948,947 | A | * | 8/1990 | Kang | 392/386 |
| 5,571,476 | A | * | 11/1996 | Newman | 422/26 |
| 6,289,530 | B1 | * | 9/2001 | Miller et al. | 4/619 |
| 6,422,180 | B1 | * | 7/2002 | Yiu | 122/404 |
| 7,604,012 | B2 | * | 10/2009 | Alpert et al. | 134/58 D |
| 2003/0016952 | A1 | * | 1/2003 | Elphee | 392/324 |
| 2004/0261824 | A1 | | 12/2004 | Eiermann | |

FOREIGN PATENT DOCUMENTS

| | | | |
|---|---|---|---|
| CN | 2109169 U | | 8/1992 |
| CN | 2614624 Y | | 12/2004 |
| DE | 2 030 5082 | * | 6/2003 |
| DE | 102 60 163 | * | 7/2007 |
| GB | 2 179 259 | * | 3/1987 |
| JP | 02-082930 | | 3/1990 |
| JP | 05-126311 | * | 5/1993 |
| JP | 09-079503 | * | 3/1997 |
| JP | 2003-093775 | * | 4/2004 |
| WO | WO 2006/037447 A1 | | 4/2006 |

* cited by examiner

*Primary Examiner* — Frankie L Stinson

(74) *Attorney, Agent, or Firm* — McKenna Long & Aldridge LLP

(57) ABSTRACT

A dish washer includes a steam generating unit that is configured to control the amount of steam in accordance with the amount of items in the dish washer. The steam generating unit is positioned outside of the tub and is configured to generate and supply steam to the tub. The dishwasher includes a fluid supplying passage that supplies washing fluid to the steam generating unit. A steam discharging passage is configured to discharge steam that is generated from the steam generating unit to the tub.

11 Claims, 7 Drawing Sheets

DISH WASHER

This application claims the benefit of Korea Patent Application No. 10-2005-0082553, filed on Sep. 6, 2006, which is hereby incorporated by reference for all purposes as if fully set forth herein.

BACKGROUND OF THE INVENTION

1. Field of the Invention

The present invention relates to a dish washer, particularly to a dish washer having a steam generating unit that improves a washing operation and enhances washing performance.

2. Discussion of the Related Art

In general, a dish washer is a home appliance that cleanses dishes with washing fluid, which is spouted out of an injection nozzle with high pressure.

A dish washer generally includes a tub, which provides a washing chamber, and a sump installed under the tub for storing washing fluid. The washing fluid is introduced into an injection nozzle by a washing pump installed in the sump, and then directed at a high pressure through an injection aperture formed at an end of an injection nozzle. The injected washing fluid cleanses dishes by removing particles, such as food remnants, which typically fall to a bottom of the tub.

To improve the washing performance, a dish washer may include a heater installed on the sump storing the washing fluid. The washing fluid is then heated by the heater. The heated washing fluid is then spouted out toward the inner part of the tub through the injecting nozzle.

However, the aforementioned device has a problem in that a foul smell often occurs when fluid in the sump is heated. Also, the durability of the heater decreases as foreign elements, e.g. food remnants, often become stuck to the heater when the foreign elements and detergent included in the washing fluid are heated at the same time. Additionally, it takes a relatively long time to heat the washing fluid, as a relatively large amount of fluid is stored in a sump. Consequently, the aforementioned device consumes a relatively large amount of energy in relation to the amount of fluid that is needed because all of the fluid stored in the sump is heated. Furthermore, some foreign elements, such as rice, are difficult to remove and clean off items in the dish washer even when washing fluid of high temperatures are used.

SUMMARY OF THE INVENTION

Accordingly, the present invention solves the above-mentioned problems. A dish washer in accordance with aspects of the present invention permits elements, such as food remnants, stuck to an item to be easily removed by providing steam to the inside of the tub.

An advantage of the present invention is to provide a home appliance that is configured to control the amount of steam generated in accordance with the amount of items in the home appliance. Additionally, the home appliance is configured to generate the steam rapidly.

A home appliance in accordance with aspects of the present invention advantageously provides steam from several directions.

To achieve these and other advantages in accordance with the purpose of the invention, as embodied and broadly described herein, a dish washer includes a tub accommodating dishes therein; a steam generating unit mounted on an outer side of the tub and generating steam for the tub; a fluid supplying passage supplying the fluid to the steam generating unit; and a steam discharging passage discharging the steam generated from the steam generating unit into the tub.

In another aspect of the present invention, a dish washer includes a tub; a steam generating unit generating the steam provided to the tub; a fluid supplying passage introducing fluid to the steam generating unit; a sump providing the washing fluid to the tub; an air break connected with the sump and the steam generating unit, the air break supplying washing fluid to the sump and supplying steam to the tub; and a washing fluid supplying passage transporting washing fluid to the air break.

In another aspect of the present invention, a dish washer includes a tub accommodating dishes therein; a steam generating unit generating steam provided to the tub; a fluid supplying passage supplying the fluid to the steam generating unit; a steam passage transferring the steam generated from the steam generating unit; an air break connected with the steam passage; and a steam discharging passage connected with the air break, and discharging the steam into the tub.

According to the present invention, it is effective and advantageous to remove elements, such as food remnants, from items, which are steeped by a humid high temperature steam supplied to the tub.

According to the present invention, it is especially effective and advantageous to steep unwanted elements, such as food remnants, from items while uniformly supplying steam to the inside of the tub by the steam discharging passage.

It is also effective that the amount of steam generated is controlled based upon the amount of items in the dish washer, as the amount of the washing fluid provided to the steam generating unit is controlled.

It is also effective and advantageous to decrease the washing time of a dish washer be removing elements stuck to the dishes by steam, thereby improving washing performance.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to the exemplary embodiments of the present invention, examples of which are illustrated in the accompanying drawings. However, the present invention should not be construed as being limited to those exemplary embodiments set forth herein, and it will be understood by those skilled in the art that additions, modifications, and deletions of features may be made without departing from the spirit and scope of the present invention.

Figure 1:
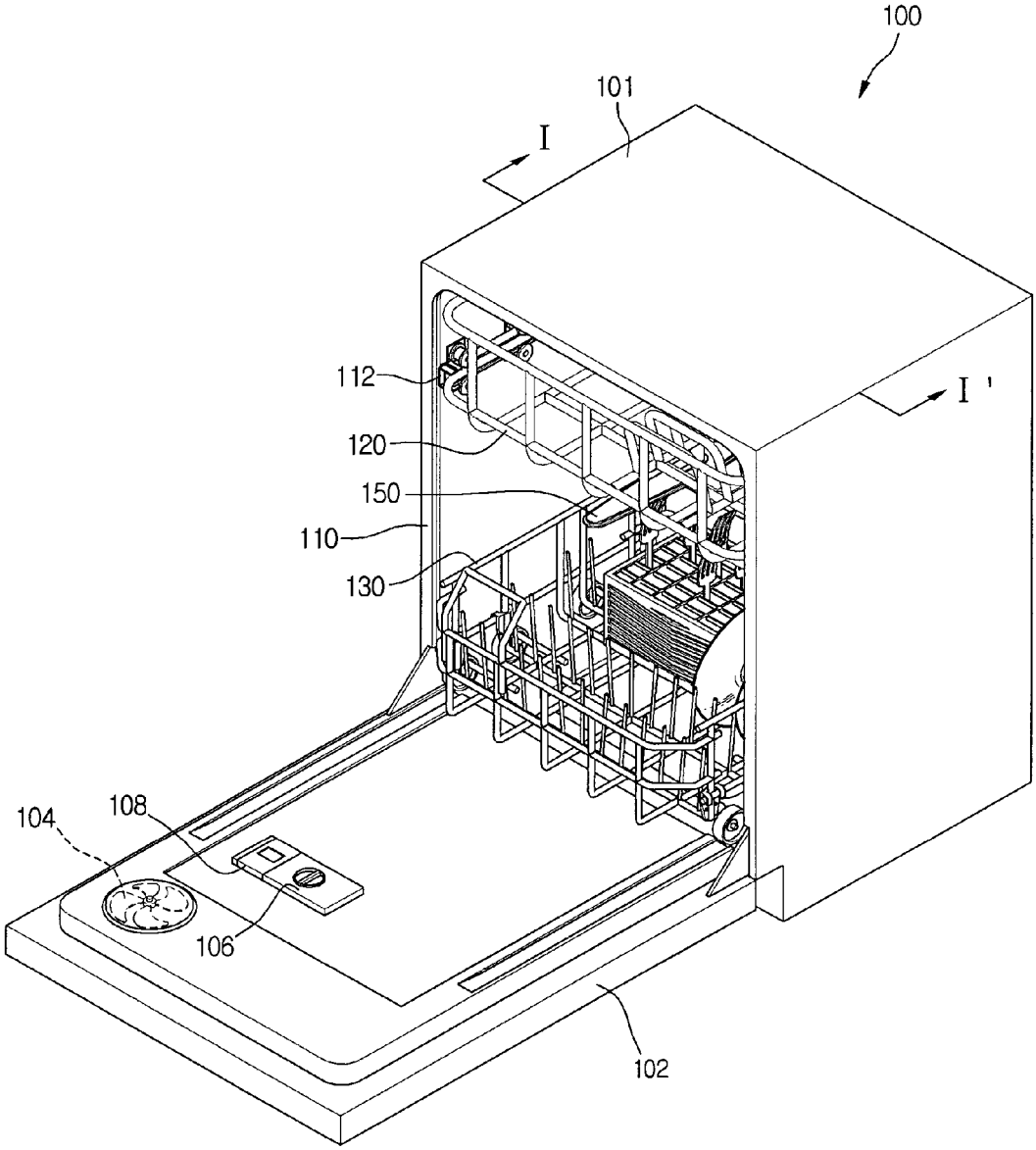
FIG. 1 is a drawing illustrating a state of a dish washer when the door is opened.

FIG. 1 is a drawing illustrating a state of a dish washer when the door is opened.

Referring to FIG. 1, the dish washer 100 according to the present invention includes a case 101 providing an external housing and having an open front. A door 102 is provided to seal and close the open front portion of the case 101. The tub 110 forms a washing chamber (or bath), which is positioned within the case 101.

The dish washer 100 further includes an upper rack 120 and a lower rack 130 which may be drawn out from the tub 110 by a sliding motion. The upper and lower racks 120, 130 are configured to accommodate items such as dishes, pots, pans, utensils, and etc. therein. An upper nozzle 150, a lower nozzle 160, and a top nozzle 155 discharge washing fluid toward the upper and lower racks 120, 130. The upper nozzle 150 and the top nozzle 155 are connected to the fluid guide 140 (see FIG. 2), and receive washing fluid from the fluid guide 140 (see FIG. 2).

A rail 112 supports the movement of the upper rack 120 along a forward and backward direction of the dishwasher. The rail 112 extends along an inside surface of the tub 110.

The door 102 is joined to the case 101 by a hinge positioned at the lower part of the door 102. The door may be rotated in forward and backward directions centering around the hinge by a user's operation. A ventilating fan 104 is formed on a predetermined location of the door 102, so the inner air of the tub 110 is discharged to the outside by the ventilating fan 104.

A rinse case 106 is formed on an inside surface of the door 102. The rinse case 106 provides the dish washer with a rinsing agent during the washing process. A detergent case 108 may be formed on one side of the rinse case 106. A constant quantity of detergent may be supplied during operation of the dish washer 100.

Figure 2:
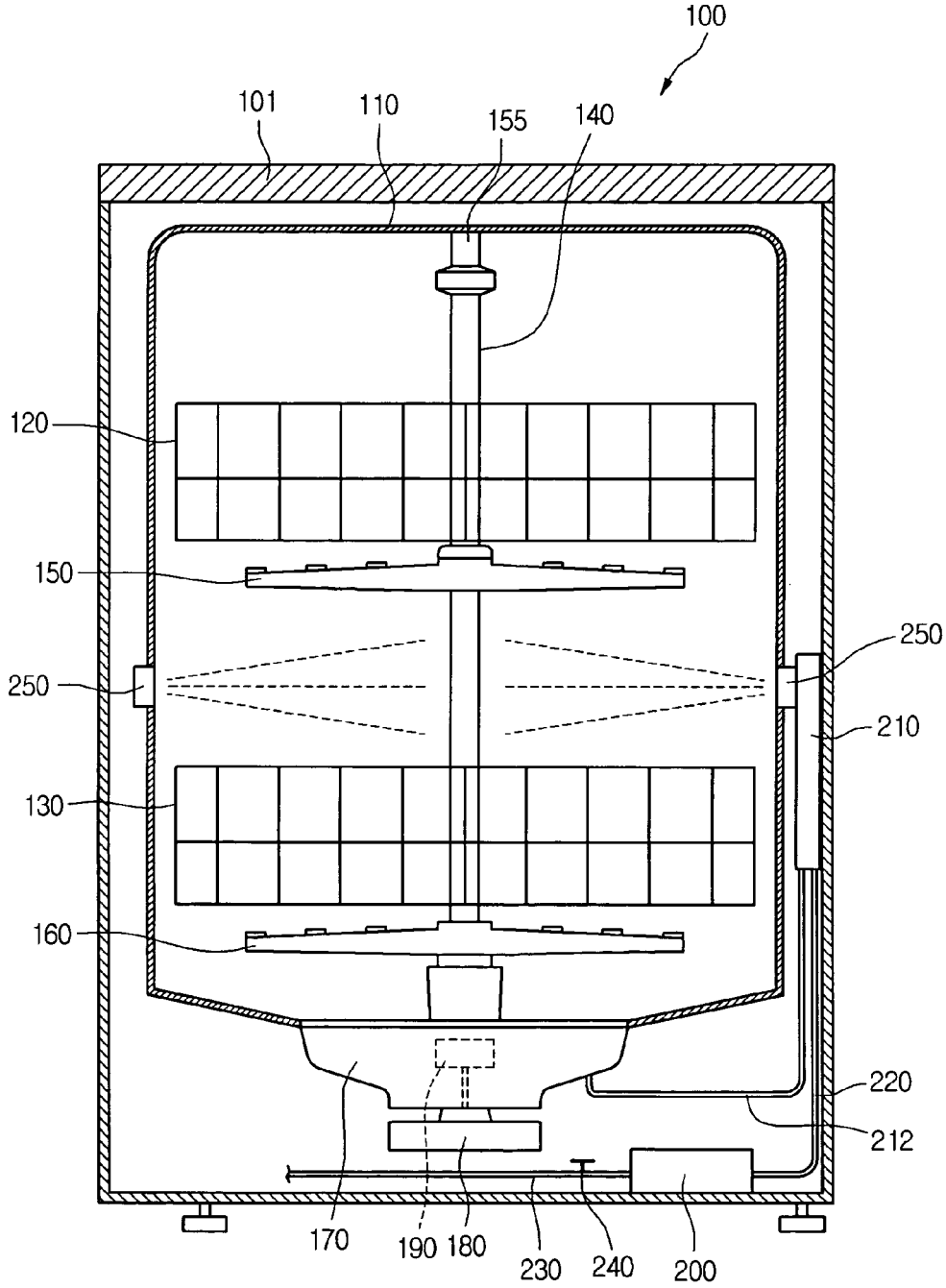
FIG. 2 is a cross-sectional view of I-I' of FIG. 1.

FIG. 2 is a cross-sectional view of I-I' of the FIG. 1.

Referring to FIG. 2, the dish washer 100 according to the present invention includes a tub 110 having a washing chamber (or bath) therein, a sump 170 installed on the lower part of the tub 110 and pumping the washing fluid, a fluid guide 140 in which the washing fluid pumped from the sump 170 moves, a washing pump 190 pumping the washing fluid stored in the sump 170 with high pressure, and a washing motor 180 connected with a shaft of the washing pump 190 and driving the washing pump 190.

The dish washer 100 further comprises an air break 210 mounted on an outer side of the tub 110, transferring the washing fluid supplied from a fluid source and having a unit to control the influx of fluid. A connecting passage 212 connects the air break 210 and the sump 170.

The dish washer 100 further includes a steam generating unit 200 positioned (or seated) on the lower side of the tub 110 and generates steam, a steam passage 220 provided as a connecting passage for the steam generated from the steam generating unit 200 that is supplied to the air break 210, a fluid supplying passage 230 connecting the steam generating unit 200 to the outside of the dish washer 100, and supplying the fluid to the steam generating unit 200.

A flux control unit 240 controls the amount of fluid supplied to the steam generating unit 200 and is installed on the fluid supplying passage 230. Because the fluid supplied through the fluid supplying passage 230 is changed into steam upon being heated while passing through the steam generating unit 200, a predetermined amount of fluid is introduced to the steam generating unit 200 to generate steam rapidly in accordance with the flux control unit 240.

With regards to the flux control unit 240, a micro pump or a valve may be used to provide accurate control and an appropriate flow amount. A solenoid valve, for example, can be used such that a state of the valve (e.g., open or closed) may be controlled in accordance with an applied electric current. The flux control unit 240 is configured to be controlled for a predetermined amount of time.

The air break 210 may also be mounted on an outer side of the tub 110, and supplies washing fluid to the sump 170, which is mounted on the lower part of the tub 110. The air break 210 supplies steam generated from the steam generating unit 200 to the tub 110.

Therefore, an embodiment may include a fluid (e.g., water) passage supplied to the sump 170 and a steam passage supplied to the tub 110, which are mounted separately.

A supplying passage (not shown) supplies fluid used for washing from an external source of the fluid. The supplying passage is connected to the air break 210.

The supplying passage connected to the air break 210 may be a washing fluid supplying passage, and the supplying passage 230 connected to the steam generating unit 200 may be a fluid supplying passage for steam.

A steam discharging passage 250 is connected to the air break 210 to discharge the steam effectively. The steam discharging passage 250 is explained, for example, by FIG. 3.

Figure 3:
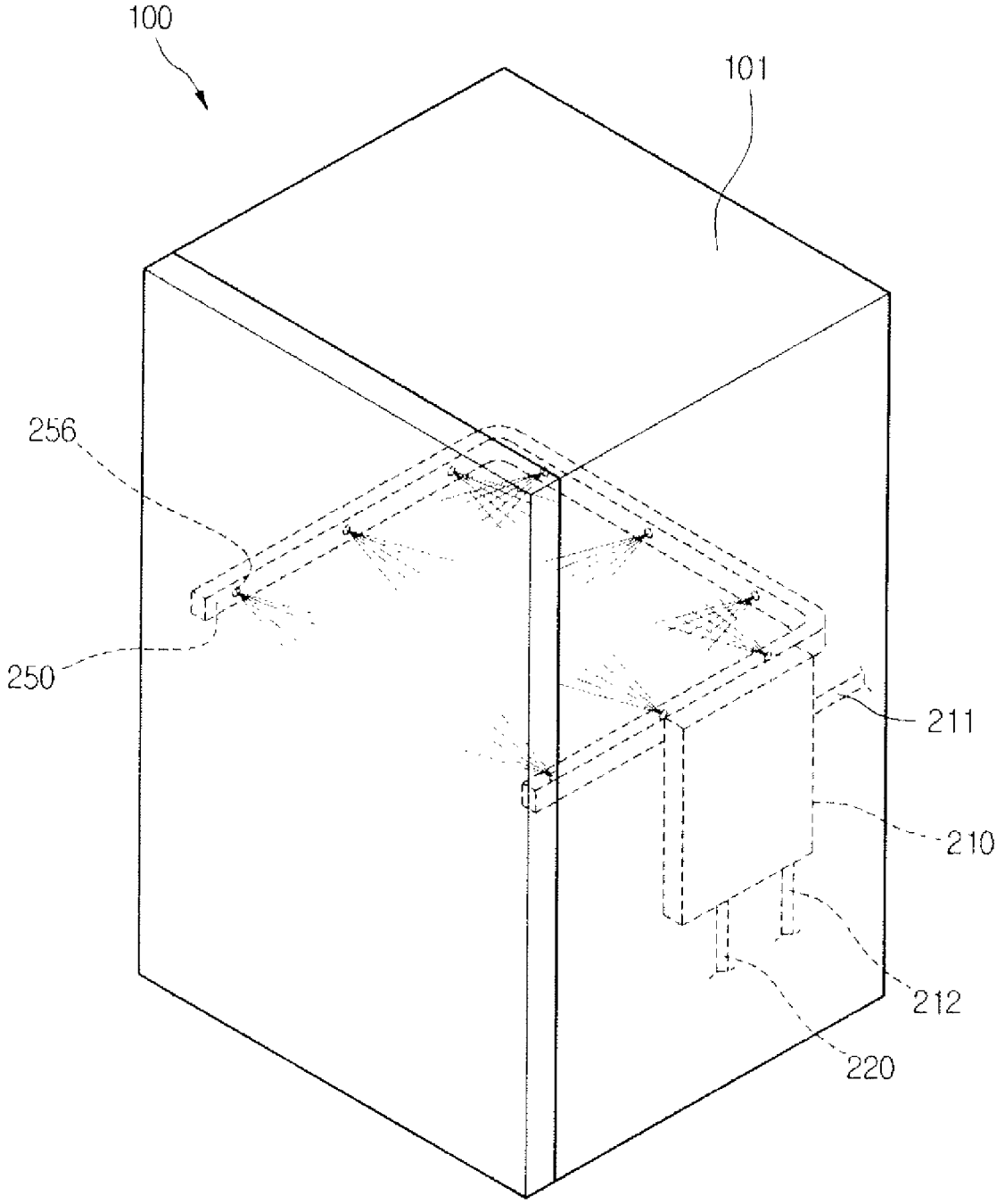
FIG. 3 is a schematic drawing illustrating a structure of the steam discharging passage according to the present invention.

FIG. 3 is a schematic drawing showing a structure of the steam discharging passage according to the present invention.

Referring to FIG. 3, the steam discharging passage 250 is provided on the outside of the tub 110, and supplies steam, discharged from the air break 210, to the inside of the tub 110.

The steam discharging passage 250 is mounted on at least one side of the tub 110. The steam discharging passage 250 is provided in a circumferential direction with respect to the tub to uniformly or equally supply steam to the inner part of the tub 110.

At least one steam discharging hole 256 discharging steam is formed on the steam discharging passage 250. The steam discharging hole 256 supplies steam circulating along the inside of the steam discharging passage 250 to the tub 110 and spreads the steam.

Therefore, the steam is equally supplied to the inside of the tub 110 and the steam supplied to the tub 110 is able to spread and travel throughout the tub 110, as the steam discharging passage 250 is externally provided along circumferential direction of the tub 110.

As steam is supplied from multiple directions, the dish washer is able to effectively remove elements, such as food remnants, stuck to the dishes.

Figure 4:
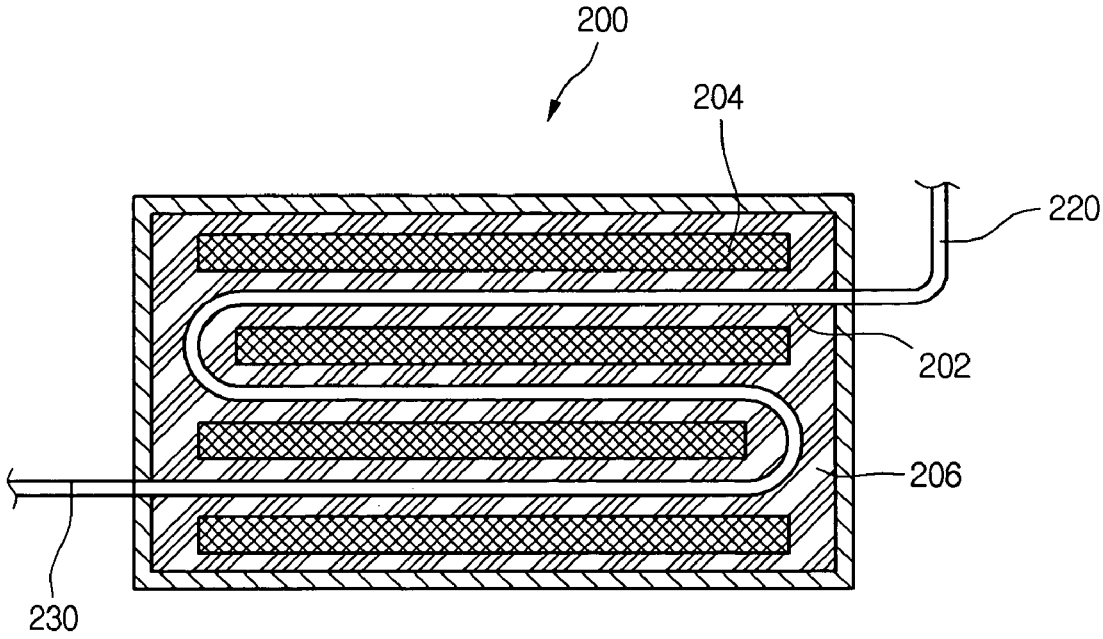
FIG. 4 is a cross-sectional view of the steam generating unit according to an embodiment of the present invention.

FIG. 4 is a cross-sectional view of a steam generating unit according to the present invention.

Referring to FIG. 4, the steam generating unit 200 is configured to generate steam by directly heating the fluid passing through the passage formed on the inside thereof.

The steam generating unit 200 includes a heating passage 202 having an end part connected with the fluid supplying passage 230 and another end part connected with the steam supplying passage 220, a heater 204 mounted near the heating passage 202 to transfer heat to the heating passage 202, a heat conduction unit 206 provided on a periphery of the heater 204 and the heating passage 202, and transferring the heat on the heater 204 rapidly to the heating passage 202.

More particularly, with regards to the heater 204, heat may be generated based upon the supply or control of power. Further, the heat conduction unit 206 may include a heat transfer medium that transfers the heat generated in the heater 204 to the heating passage 202 and may include a material having high heat conduction.

The heating passage 202 may be formed to have several bends within the steam generating unit 200. That is, the circulating course of the fluid that is introduced to the steam generating unit 200 is configured to be longer than a length of the steam generating unit. Therefore, as the heating passage 202 is formed with several bends, the heat supplied to the heating passage 202 from the heater 204 is optimized, so the heat transfer performance is increased and the steam is able to be rapidly generated.

It is also advantageous that steam is able to be generated and fluid is able to be supplied to the heating passage 202, as the amount of fluid introduced to the heating passage 202 is controlled by the flux control unit 240.

As a plurality of the heaters 204 are installed, the caloric value transferred to a heater 204 is able to be controlled by the power source thereto, and the amount of generated steam is able to be controlled by the flux control unit 240.

That is, in case that the amount of dishes or items in the dish washer is great, a lot of fluid is able to be supplied to the steam generating unit 200 from the flux control unit 240, and thus a lot of steam is able to be supplied.

A steam generating unit 200 with a heating passage and a method thereof are provided in accordance with aspects of the present embodiment. In addition, various steam generating units 200 may be provided, as well as various methods associated with the steam generating unit 200.

A method of operating the dish washer 100 is explained according to the above-mentioned constitution based on the following.

First, a user opens the door 102 of the dish washer 100, and pulls the upper rack 120 or the lower rack 130 outward from the washing tub or bath 110. Then, items such as dishes may be placed on the racks 120, 130. Then, the door 102 is closed and the dish washer 100 is configured to operate.

During the washing process, washing fluid supplied from the fluid source passes through the air break 210, and the washing fluid is introduced to the inside of the sump 170 by the connecting passage 212.

When the washing fluid introducing process is completed, the washing motor 180 is operated. Further, the washing fluid is pumped to the lower nozzle 160 and the fluid guide 140 as an impeller (not shown) mounted on the inside of the washing pump 190 shaft is connected with the washing motor 180.

The washing fluid is also pumped to a fluid guide 140 and is finally transferred to the upper nozzle 150 and the top nozzle 155, and spouted out to the inside of the washing chamber (or bath). Further, passing through the process, the dishes accommodated on the dish racks 120, 130 are washed by the washing fluid.

The dishes accommodated on the upper rack 120 are washed by the top nozzle 155 injecting washing fluid downward and substantially perpendicularly, and the upper nozzle 150 discharging fluid upward and substantially perpendicularly.

The dishes accommodated on the lower rack 130 are also washed by the lower nozzle 160 discharging washing fluid upward and substantially perpendicularly. As injection nozzles are formed on the lower surface of the upper nozzle 150, the washing fluid is injected in upward and downward directions, so the upper side of items such as dishes accommodated on the lower rack 130 are able to be washed.

When the washing process is completed, the foreign elements in the washing fluid of the sump 170 are strained out by a filter (not shown). The washing fluid (in which foreign elements are strained out) is discharged out of the dish washer 100.

After the washing fluid containing the foreign elements is discharged out of the dish washer 100, then clean washing fluid is supplied to the sump 170, and injected out through the upper and lower nozzles 150, 160 as described in the above-mentioned washing process. The dishes are passed through the rinsing process by the injected clean washing fluid.

After the rinsing process is completed and the drying process has passed, the washing operation is completed.

After operation of the dish washer 100 has progressed, then steam generated from the steam generating unit 200 and supplied to the tub 110 is further progressed.

In detail, the fluid introduced through the fluid supplying passage 230 is introduced to the inside of the steam generating unit 200 by the flux control unit 240. At this time, the operation of the flux control unit 240 may be controlled differently in accordance with the amount of the dishes accommodated on the tub 110, and according to this, the amount of washing fluid supplied to the steam generating unit 200 may be controlled.

Fluid introduced to the steam generating unit 200 is heated while circulating in the heating passage 202. Then, the fluid flowing in the heating passage 202 is changed into steam, and the steam is introduced to the air break 210 through the steam passage 220.

The steam introduced to the air break 210 is discharged to the steam discharging passage 250. Then, the steam circulates within the steam discharging passage 250, and is supplied to the inside of the tub 110 through the steam discharging holes 256.

Advantageously, particles such as the food scraps that are stuck to the dishes are removed more effectively because steam is provided to the inside of the tub 110. That is, elements such as food scraps are able to be removed easily from the dishes as the food scraps stuck to the dishes are steeped by the humid and high temperature steam. In addition, items in the dish washer may be sterilized by the high temperature steam.

Advantageously, the amount of steam that is generated is controlled properly according to the amount of items in the dish washer as the amount of fluid provided to the steam generating unit 200 is able to be controlled.

In addition, steam is able to be supplied from multiple directions by the steam discharging passage 250, and the supplied steam is able to spread rapidly inside of the tub 110.

Also, the washing time of the dish washer 100 can be reduced and washing performance can be improved because food scraps stuck to the dishes are able to be easily removed by the steam.

Figure 5:
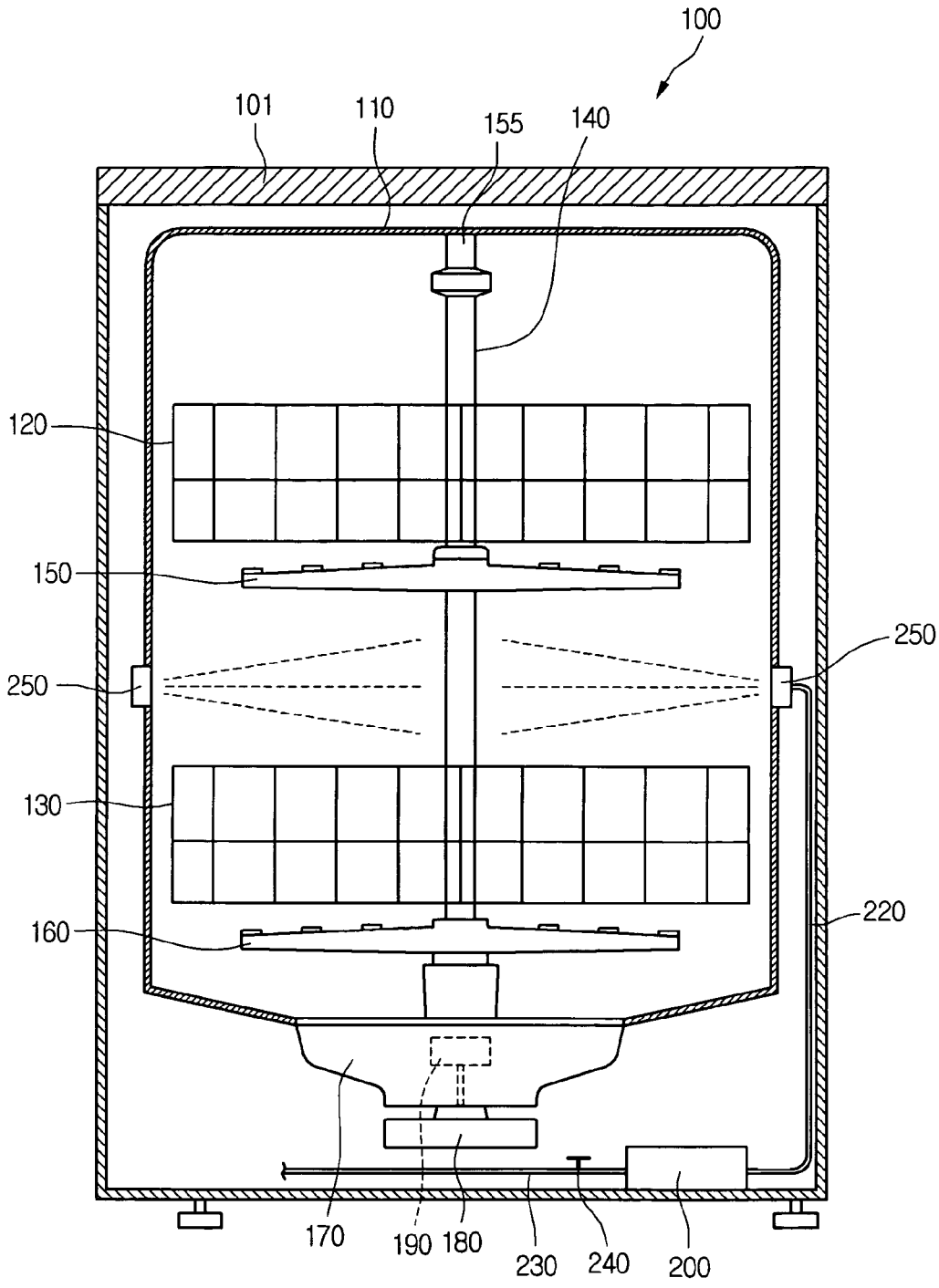
FIG. 5 is a cross-sectional view of the dish washer according to another embodiment of the present invention.

FIG. 5 is a cross-sectional view of a dish washer according to another embodiment of the present invention.

Referring to FIG. 5, similar features are identified with similar reference numerals. FIG. 5 presents a different circulating course of steam.

In FIG. 5, an end of the steam generating unit 200 is connected with the fluid supplying passage 230, and the other end is connected with the steam passage 220. Further, the steam circulated in the steam passage 220 is introduced to the steam discharging passage 250. That is, the steam passed through the steam passage 220 is introduced to the steam discharging passage 250 without passing through air break 210.

Therefore, since the circulating course of the steam is shortened, the steam can be provided more rapidly to the tub 110. Further, it is advantageous that the loss of heat is reduced since the circulating course of the steam is simplified.

Figure 6:
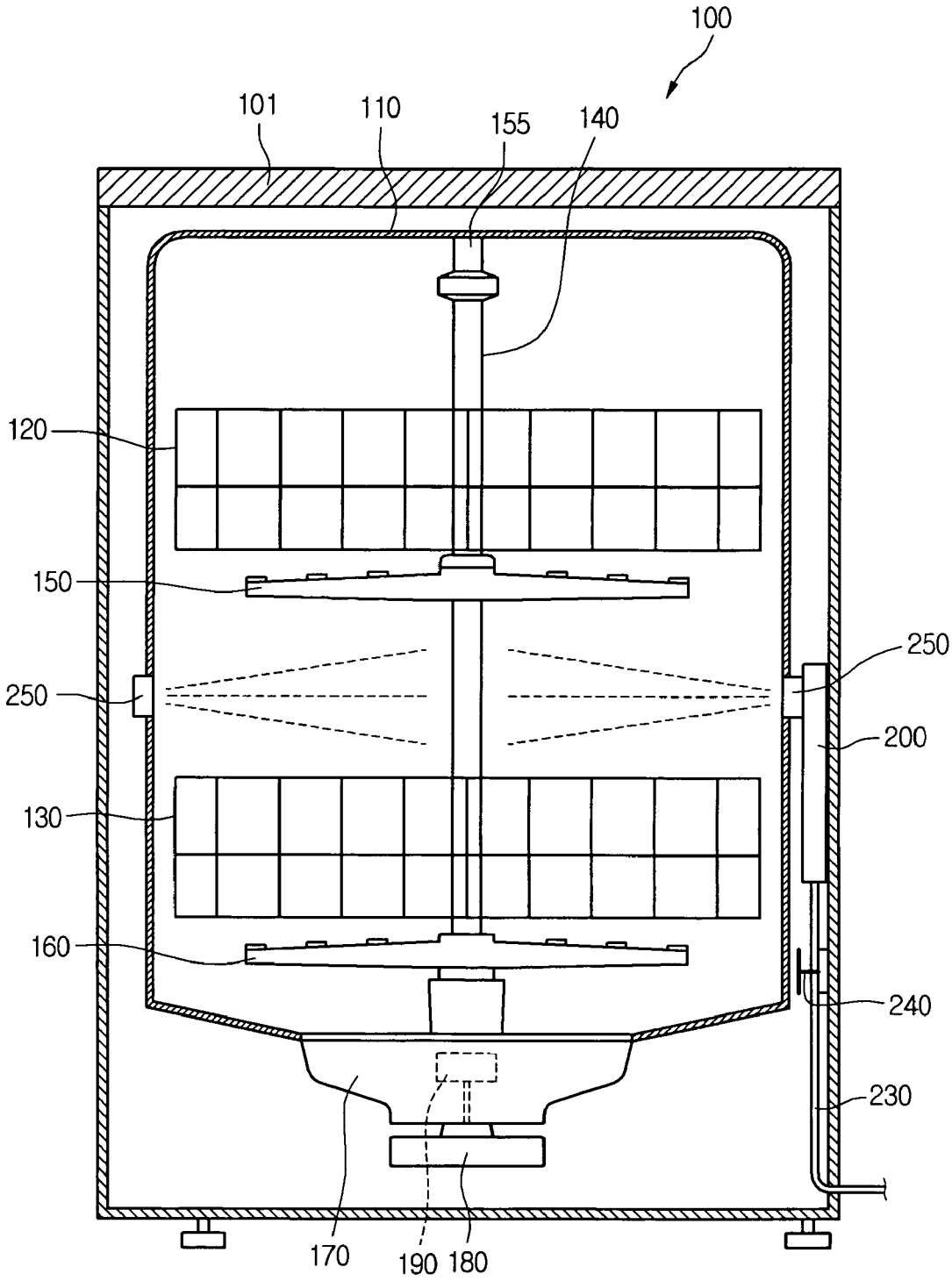
FIG. 6 is a cross-sectional view of the dish washer according to another embodiment of the present invention.

FIG. 6 is a cross-sectional view of a dish washer according to further another embodiment of the present invention.

Referring to FIG. 6, similar features are identified with similar reference numerals. FIG. 6 presents an embodiment having a different circulating course of the steam.

In particular, the steam generating unit 200 is mounted on an outer side of the tub 110. Further, an end of the steam generating unit 200 is connected with the fluid supplying passage 230, the other end is connected with the steam discharging passage 250.

That is, the steam generated from the steam generating unit 200 is directly introduced to the steam discharging passage 250.

Therefore, as the circulating course of the steam is minimized, the steam is more rapidly provided when steam is generated from the steam generating unit 200.

As the steam is provided more rapidly, it is also advantageous that rapid washing is possible, and washing performance is improved as the loss of the heat is minimized.

Figure 7:
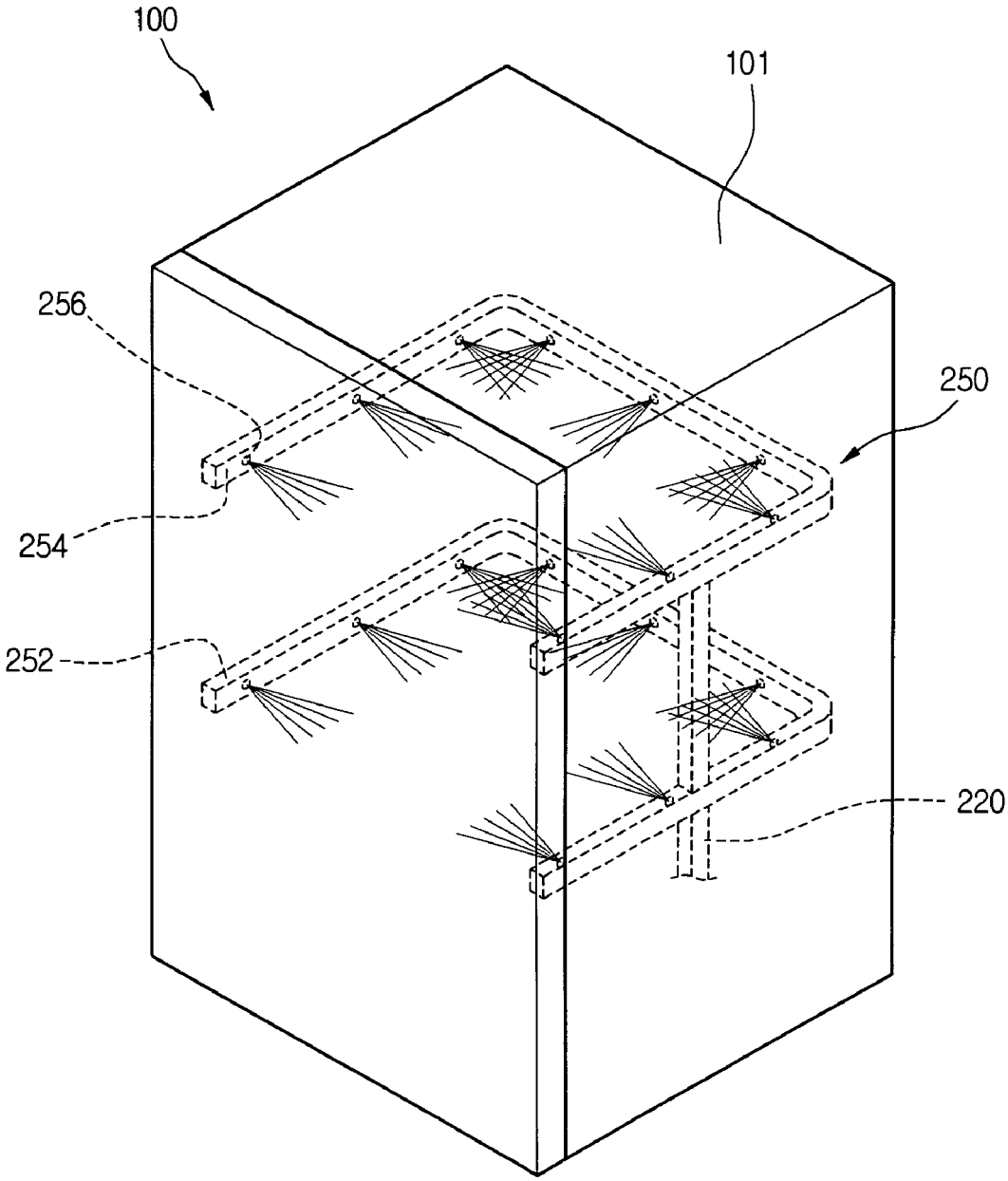
FIG. 7 is a schematic drawing illustrating a structure of the steam discharging passage according to another embodiment of the present invention.

FIG. 7 is a schematic drawing showing the structure of the steam discharging passage according to another embodiment of the present invention.

Referring to FIG. 7, similar features are provided with similar reference numerals. FIG. 7 illustrates a different circulating course for the steam.

For example, the steam discharging passage 250 is provided in a circumferential direction on the outer surface or side of the tub 110, and provided on the up and down sides respectively.

Particularly, the steam discharging passage 250 comprises a lower discharging passage 252 provided on the lower part of the tub, and an upper discharging passage 254 provided on the upper side of the lower discharging passage 252. At least one steam discharging hole 256 is formed on the upper and lower discharging passages 252, 254.

The upper discharging passage 254 provides steam toward the upper rack 252, and the lower discharging passage 254 provides steam toward the lower rack 130.

The steam, supplied into the steam discharging passage 250, passes through the steam passage 220 or the air break 210, or is supplied directly from the steam generating unit 200. In FIG. 7, steam is supplied passing through the steam passage 220.

Therefore, steam is able to be supplied uniformly to the inside of the tub 110, as the steam discharging passage 250 is composed of an upper steam passage 254 and a lower steam passage 252. Advantageously, items in the dish washer are steeped rapidly, and thus, the washing performance is maximized as the steam is provided directly to the items accommodated on the dish racks 120, 130.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dish washer comprising:
a case forming an external appearance of the dish washer;
a tub located in the case;
a steam generating unit to generate steam for the tub and located between the case and the tub;
a fluid supplying passage to introduce water into the steam generating unit;
a sump to supply washing water to the tub;
an air break comprising a first passage through which water flows into the sump and a second passage through which steam flows into the tub; and
a washing water supplying passage connected with the air break and supplying water to the air break.

2. The dish washer according to claim 1, further comprising a steam passage connecting the steam generating unit and the air break.

3. The dish washer according to claim 1, further comprising a control unit to control an amount of fluid introduced into the steam generating unit from the fluid supplying passage.

4. The dish washer according to claim 1, wherein the air break is connected to a steam discharging passage such that steam is discharged to the tub with increased speed and pressure.

5. The dish washer according to claim 4, wherein the steam discharging passage is provided on at least one side of the tub.

6. The dish washer according to claim 4, wherein the steam discharging passage includes at least one steam discharging hole.

7. The dish washer according to claim 4, wherein the steam discharging passage comprises:
an upper discharging passage discharging steam to the upper part of the tub; and
a lower discharging passage connected with the upper discharging passage, and discharging steam to the lower part of the tub.

8. A dish washer comprising:
a case forming an external appearance of the dish washer;
a tub located in the case and providing a washing chamber;
a sump containing water supplied into the tub;
a steam generating unit mounted between the case and the tub to generate steam supplied to the tub;
a fluid supplying passage to supply water to the steam generating unit;
a steam passage transferring steam generated from the steam generating unit;
an air break connected with the sump and the steam passage; and
a steam discharging passage connected with the air break, and discharging steam to the tub.

9. The dish washer according to claim 8, wherein the steam discharging passage extends substantially horizontal along a side of the tub.

10. The dish washer according to claim 9, wherein the steam discharging passage is provided on at least two adjacent sides of the tub.

11. The dish washer according to claim 8, wherein the steam discharging passage includes a plurality of steam discharging holes spaced from each other.

* * * * *